US006447346B2

(12) United States Patent
Sasaki et al.

(10) Patent No.: US 6,447,346 B2
(45) Date of Patent: Sep. 10, 2002

(54) MULTIPOLAR CONNECTOR APPARATUS WITH FORCE TRANSMITTING MEMBER

(75) Inventors: Harehide Sasaki; Keiichi Ito; Kazuyuki Shiraki; Masanori Wakui, all of Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/795,366

(22) Filed: Mar. 1, 2001

(30) Foreign Application Priority Data

Mar. 2, 2000 (JP) ..... 2000-057120

(51) Int. Cl.[7] ..... H01R 9/22

(52) U.S. Cl. ..... 439/924.1; 439/262; 439/310; 439/595; 439/635; 439/701

(58) Field of Search ..... 439/310, 924.1, 439/924.2, 259, 362, 635, 595, 262, 701

(56) References Cited

U.S. PATENT DOCUMENTS 4,867,699 A * 9/1989 Oda et al. ..... 439/355
5,447,454 A * 9/1995 Inaba et al. ..... 439/709
5,582,180 A * 12/1996 Manset et al. ..... 128/696
5,904,597 A * 5/1999 Doi et al. ..... 439/660
6,056,570 A * 5/2000 Maejima ..... 439/259
6,247,937 B1 * 6/2001 Miwa et al. ..... 439/59

* cited by examiner

*Primary Examiner*—Tho D. Ta
*Assistant Examiner*—Truc Nguyen
(74) *Attorney, Agent, or Firm*—Morgan, Lewis & Bockius LLP

(57) ABSTRACT

A plurality of steps respectively constituted by inner housings (19) are incorporated into an outer housing (18) of a female connector (12). Moreover, a pushing operation force transmitting member (20) is incorporated there into. The engaging relation of this pushing operation force transmitting member (20) to each of the inner housings is changed every time this member is externally operated. Thus, a pushing operation force applied to the outer housing (18) is transmitted to the inner housings (19) sequentially. Consequently, the outer housing (18) and the pushing operation force transmitting member (20) are alternately pushed. Thus, the plurality of steps respectively constituted by the inner housings (19) are sequentially connected to a male connector (12).

4 Claims, 12 Drawing Sheets

A
B

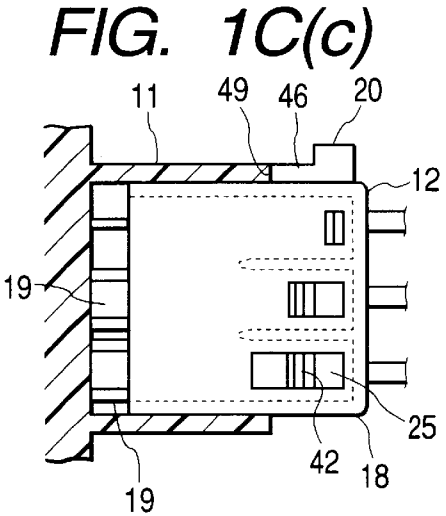
FIG. 1C(a)
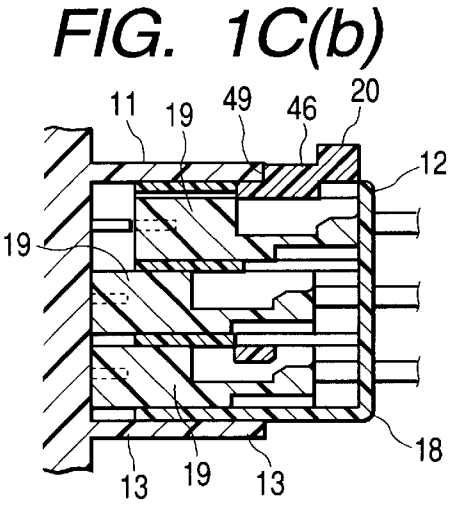
FIG. 1C(b)
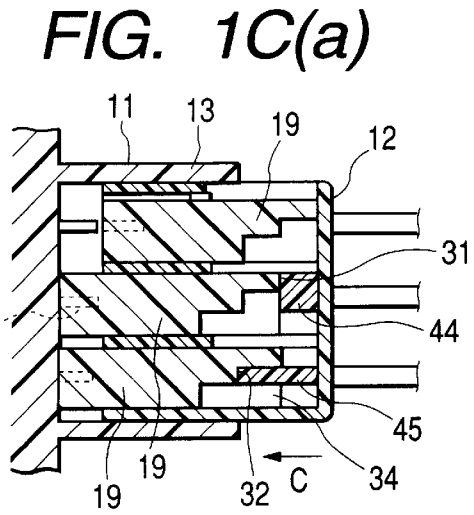
FIG. 1C(c)
FIG. 1D(a)
FIG. 1D(b)
FIG. 1D(c)

MULTIPOLAR CONNECTOR APPARATUS WITH FORCE TRANSMITTING MEMBER

BACKGROUND OF THE INVENTION

1. Technical Field of the Invention

The present invention relates to a connector apparatus suitable for use as a multipolar connector.

2. Related Art

A connector apparatus for use in connecting electric wirings to one another has been in circumstances where contact I frictional resistance between contacts on connection of male and female connectors increases with increase in the number of contacts, so that a large operating force is needed therefor.

Thus, a multipolar connector having many contacts needs a larger force for performing a connecting operation.

As a countermeasure against this, there has been previously provided, for example, an apparatus illustrated in FIG. 14, in which a plurality of female connectors 2 (three female connectors 2*a*, 2*b*, 2*c*, in this case) are formed correspondingly to one male connector 1 by dividing a single female connector there into and respectively connected to portions 1*a*, 1*b*, and 1*c*, to which the female connectors should be connected, of the male connector 1.

In the case of the apparatus configured as described herein above, the number of contacts of each of the female connectors 2*a*, 2*b*, and 2*c* is reduced (incidentally, although each of the female connectors has contacts respectively corresponding to contacts 3 of the male connector 1, the drawing of such contacts of each of the female connectors is omitted) Consequently, an operating force needed for the connection between the male connector 1 and each of the female connectors 2*a*, 2*b*, and 2*c* can be reduced.

However, there has been necessity for connecting a plurality of female connectors 2*a*, 2*b*, and 2*c* to the portions 1*a*, 1*b*, and 1*c* of the male connector 1, respectively. Such an operation is troublesome.

SUMMARY OF THE INVENTION

The invention is accomplished in view of the aforementioned circumstances. Accordingly, an object of the invention is mainly to provide a connector apparatus that can reduce an operating force needed for connecting male and female connectors to each other and facilitate a connecting operation.

To achieve the foregoing object, according to the invention, there is provided a connector apparatus having a male connector and a female connector, one of the male connector and a female connector comprising:

an outer housing;

a plurality of inner housings positioned in steps and provided in the outer housing, each of the inner housings having at least one contact; and a pushing operation force transmitting member engageable with the plurality of inner housings in a plurality of engagement states which is changed per the pushing operation force transmitting member is externally operated, which is incorporated into the outer housing, wherein the pushing operation force transmitting member sequentially transmits a pushing force which is applied to the outer housing in a direction of the other connector to each inner housings by changing the plurality of engagement states.

With this configuration, a plurality of steps respectively constituted by the inner housings are sequentially connected to the counterpart connector by alternately pushing the outer housing and the pushing operation force transmitting member.

In this case, preferably, the connector apparatus further comprises a separating operation force transmitting means, which are provided between the outer housing and each of the inner housings, for transmitting a separating operation force, which is applied to the outer housing in a direction opposite to the direction of the counterpart connector, to the inner housings sequentially.

With this configuration, the inner housings are sequentially separated from the counterpart connector by a separating operation using the outer housing.

Further in this case, preferably, each of the plurality of inner housings has same shape.

Further in this case, preferably, the pushing operation force transmitting member is movable in a direction substantially perpendicular to the direction of other connector.

DESCRIPTION OF PREFERRED EMBODIMENT

Hereinafter, an embodiment of the invention is described with reference to FIGS. 1A(*a*) to 13C.

Figure 4:
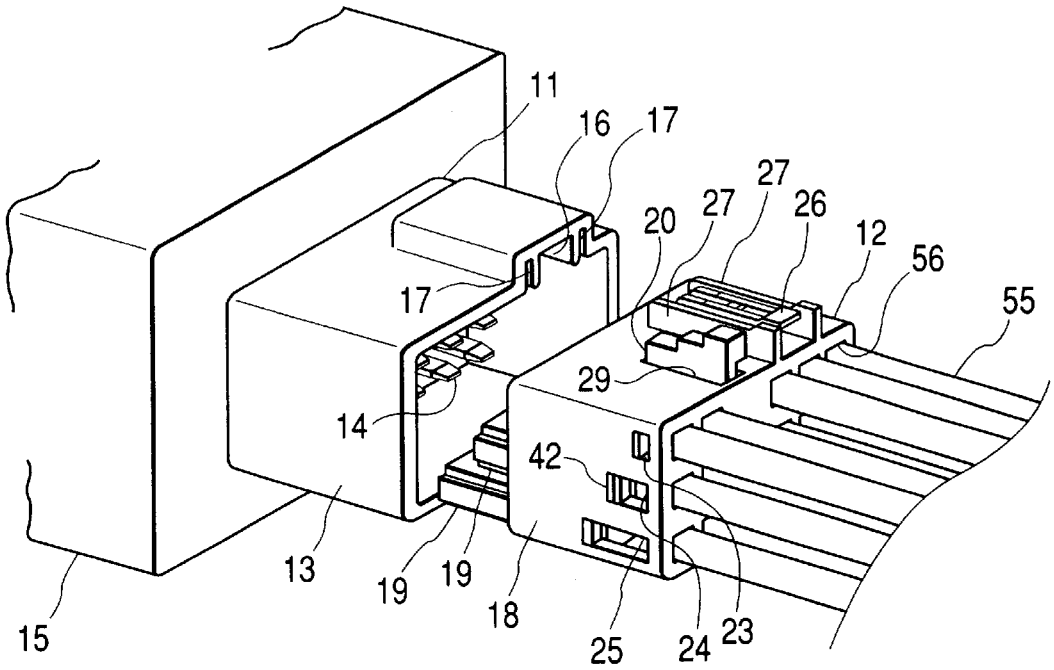
FIG. 4 is a perspective view illustrating the male connector and the female connector, which are not connected to each other yet.

Referring first to FIG. 4, there are shown a male connector 11 and a female connector 13 in a state in which these connectors are not connected to each other yet. Between these connectors, the male connector 11 is configured by employing a housing 13 as an outer shell, and providing many male contacts 14 in this housing.

Particularly, in this case, the housing 13 is formed of an insulating material, such as plastics, in such a way as to be integral with a base portion 15 having an electrically conductive part (not shown) to be connected to the male contacts 14. The housing 13 is shaped nearly like a rectangular box whose right-side end face is opened, as viewed in this figure. The male contacts 14 are provided in such a way as to project from an inner part of this housing 13 toward an opened part thereof, and to be positioned in rows across the width of the housing 13 and in steps (in this case, three steps) across the height thereof. The male contacts 14 are made of an electrically conductive material and each shaped like a pin. A base end portion of each of the male contacts 14 is connected to an electrically conductive part of the base portion 15.

An inwardly concave portion 16 and two guide grooves 17 provided in opposite sides of the inwardly concave portion 16 are formed in the top portion of the housing 13 in such a way as to project upwardly therefrom and to extend from the opened-part side to the inner-part side thereof. Moreover, a nail hook part (not shown) is formed in an upper inner portion of the concave portion 16.

On the other hand, the female connector 12 is configured by employing an outer housing 18 as an outer shell, and incorporating a plurality of inner housings (in this case, three inner housings) 19 and a pushing operation force transmitting member 20 into this housing 18.

The outer housing 18 is separately formed of an insulating material, such as plastics, and shaped like a rectangular box whose left-side face is opened, as viewed in the figures, in contrast with the housing 13 of the male connector 11. The outer housing 18 is formed in such a manner as to be a size smaller than the housing 13 of the connector 11 so that the housing 13 can accommodate the housing 18 with almost no space therebetween.

Figure 5:
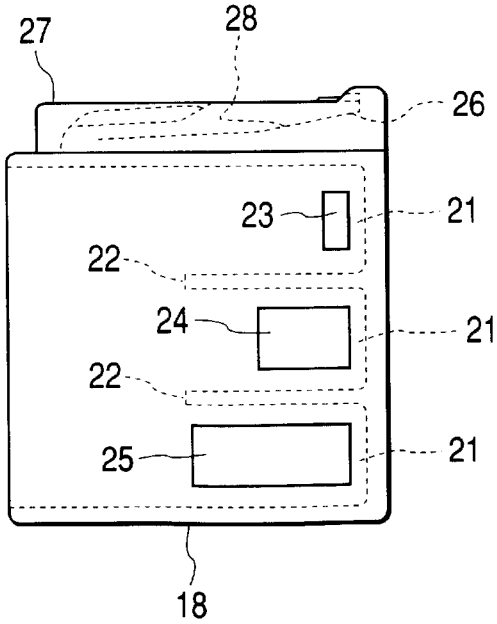
FIG. 5 is a side view illustrating a single outer housing.

As shown in FIG. 5, partitions 22 for partitioning the inside of the outer housing 18 into a plurality of chambers 21 positioned in steps (in this case, three steps) across the height thereof are formed on the inner part side of this housing 18. Further, rectangular holes 23, 24, and 25 are formed in opposite side walls of this outer housing 18 in such a way,as to have positions respectively adjusted to those of the chambers 21 and as to have different lengths in a direction from the inner part side to the opened part side. In this case, among those holes, the hole 23 formed in the highest step is the shortest one. The hole 24 formed in the middle step is the second longest one. The hole 25 formed in the lowest step is longer than the hole 24.

Figure 6:
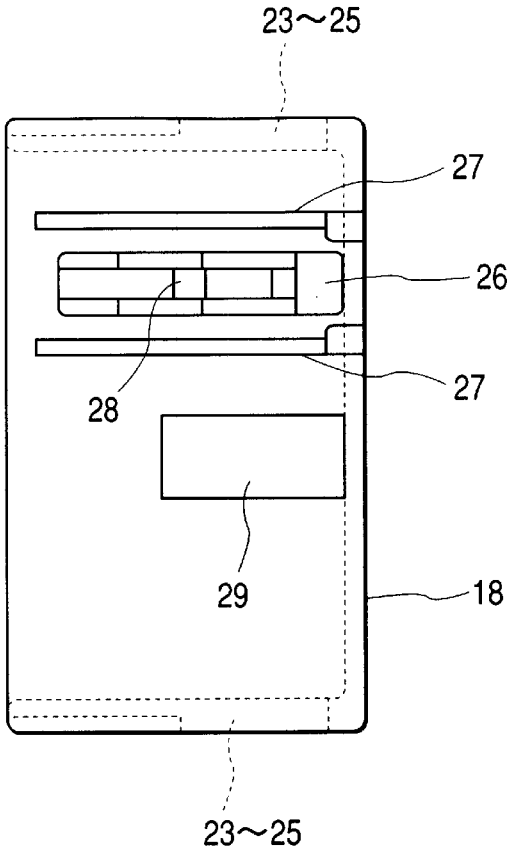
FIG. 6 is a plan view illustrating the single outer housing.

On the other hand, as shown in FIG. 6, an elastic tongue strip 26 and ribs 27 are formed on the top portion of the outer housing 18. Among the elastic tongue strip 26 and the ribs 27, the elastic tongue strip 26 is accommodated in the concave portion 16 of the male connector 11 and has a nail 28 to be engaged with the nail hook part. The ribs 27 are accommodated in the guide grooves 17 and provided on opposite sides of the elastic tongue strip 26.

Further, a rectangular hole 29 elongated in a direction from the inner part side to the opened part side of this outer housing 18 is formed in the top portion thereof. A cutout (not shown), which has a size equal to that of the hole 29 is formed correspondingly to the hole 29 in each of the partitions 22.

Figure 7:
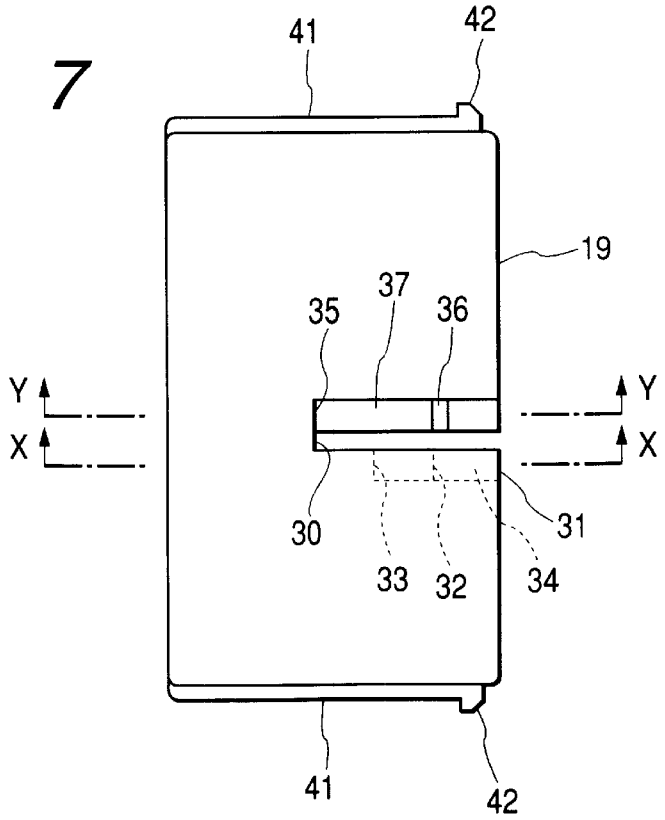
FIG. 7 is a plan view illustrating a single inner housing.
Figure 8:
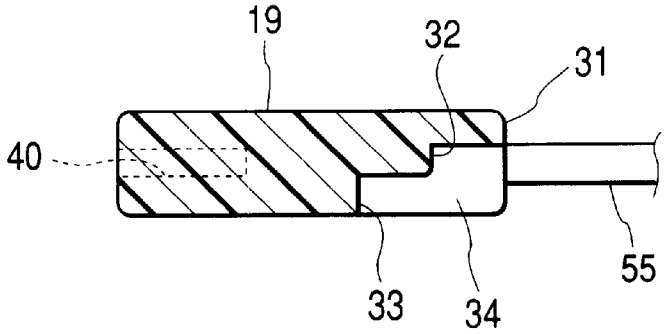
FIG. 8 is a longitudinally sectional side view of the single inner housing, which is taken along line X—X of FIG. 7.
Figure 9:
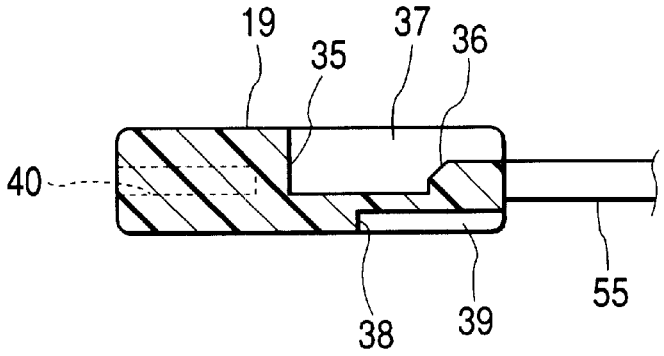
FIG. 9 is a longitudinally sectional side view of the single inner housing, which is taken along line Y—Y of FIG. 7.

Each of the inner housings 19 is made of an insulating material, such as plastics, and formed like a rectangular flat block shown in FIG. 7. A cutout portion 30 corresponding to the hole 29 of the outer housing 18 is formed in a rear side portion near to a central portion of each of the inner housing 19. Furthermore, a concave portion 34, in which a plurality of (in this case, three) step parts 31, 32, and 33 serving as engaging portions extending in frontward and backward directions are formed as illustrated in FIG. 8, is formed in the bottom-surface side of one (in this case, a lower side, as viewed in FIG. 7) of opposite sides of the cutout portion 30 of this inner housing 19. Further, a concave portion 37, in which step parts 35 and 36 serving as engaged parts extending in the frontward and backward directions are formed as illustrated in FIG. 9, is formed in the top-surface side of the other side (in this case, an upper side, as viewed in FIG. 7) of the cutout portion 30 of the inner housing 19. A concave portion 39, in which a step part 38 is formed, is formed in the bottom surface side thereof. Incidentally, in this case, the step parts 31 to 33, 35, and 38 are each shaped like an upright face facing the backward side, while the step part 36 is shaped like a slope that faces the front side and that has an upward inclination to the rear side.

Figure 10:
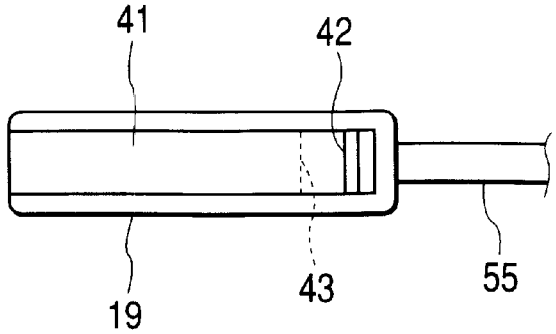
FIG. 10 is a side view illustrating the single inner housing.

Furthermore, a male contact 40 to be fitted into and brought into contact with the male contact 14 of the male connector 11 is embedded in a part extending from the front face portion to the inner portion of the inner housing 19. Additionally, as shown in FIG. 10, convex ridge portions. 41 are respectively formed on opposite sides of the inner housing 19. A projection 42 is formed at a rear end portion of each of the convex ridge portions 41. Incidentally, holes 43 are formed in opposite lateral side surface portions of the inner housing 19. Consequently, the projection 42 of the convex ridge portion 41 can be elastically deformed in inward and outward directions of the inner-housing 19.

Figure 11:
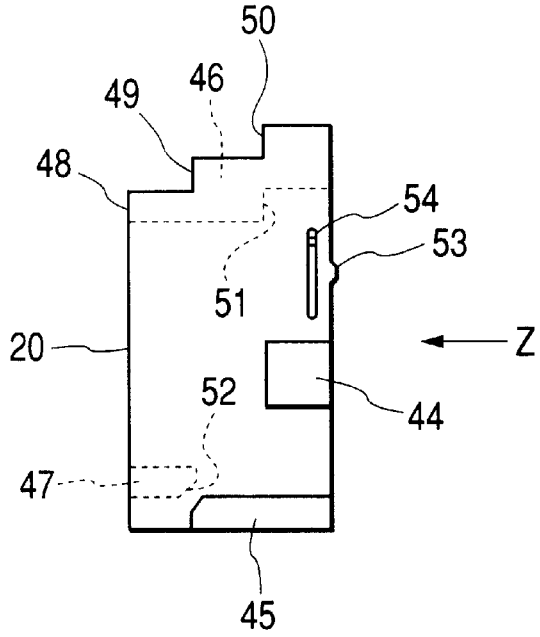
FIG. 11 is a side view illustrating a pushing operation force transmitting member.
Figure 12:
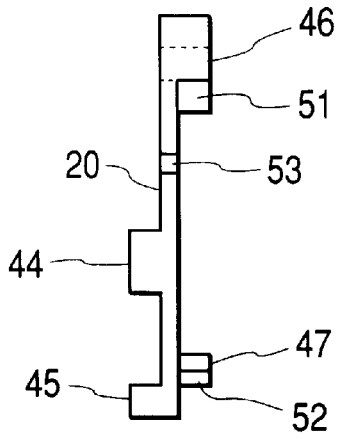
FIG. 12 is a rear view illustrating the pushing operation force transmitting member viewed from a direction of an arrow Z of FIG. 11.
Figure 13C:
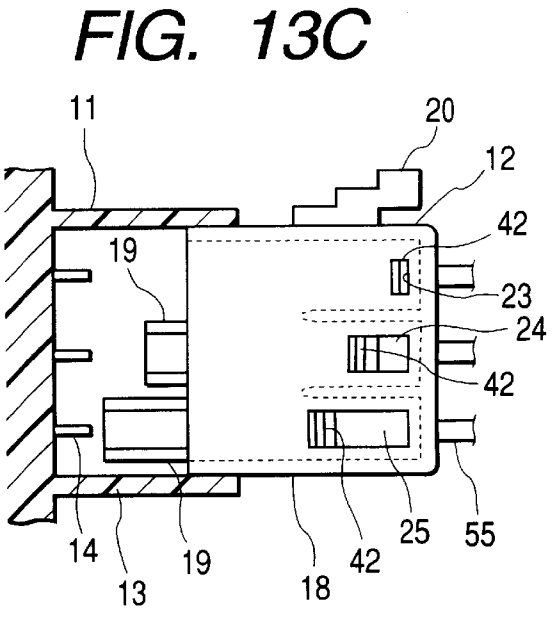
FIGS. 13A, 13B, and 13C are longitudinally sectional views respectively taken at different sectional positions 13A, 13B, and 13C and each illustrating the male connector and the female connector, which are not connected to each other yet.
Figure 13B:
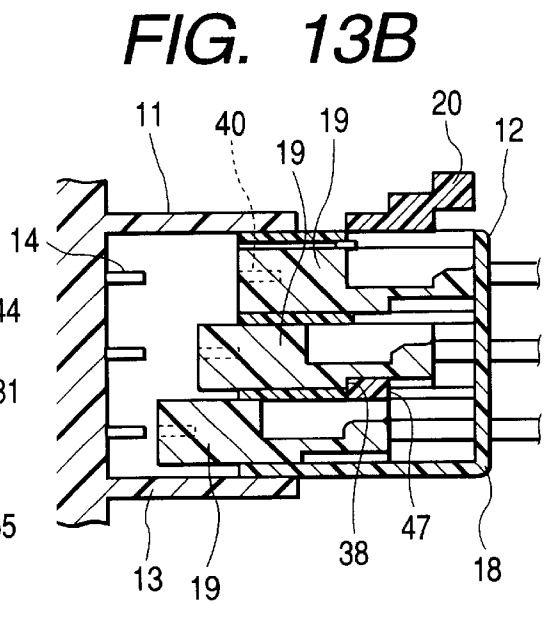
Figure 13A:
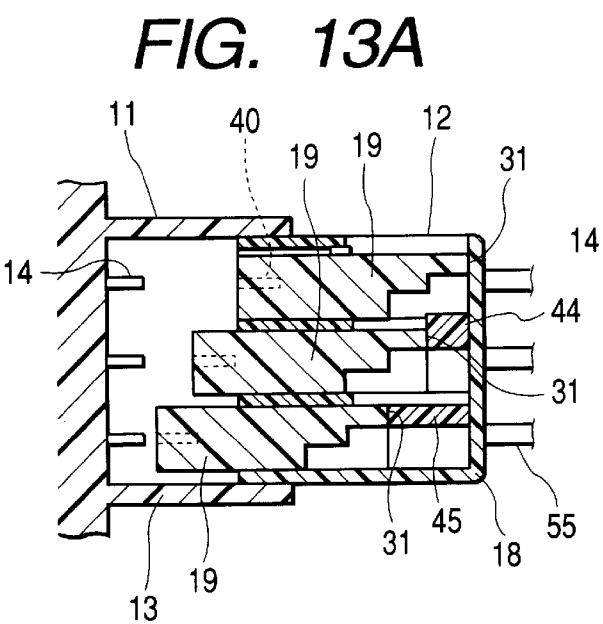
Figure 14:
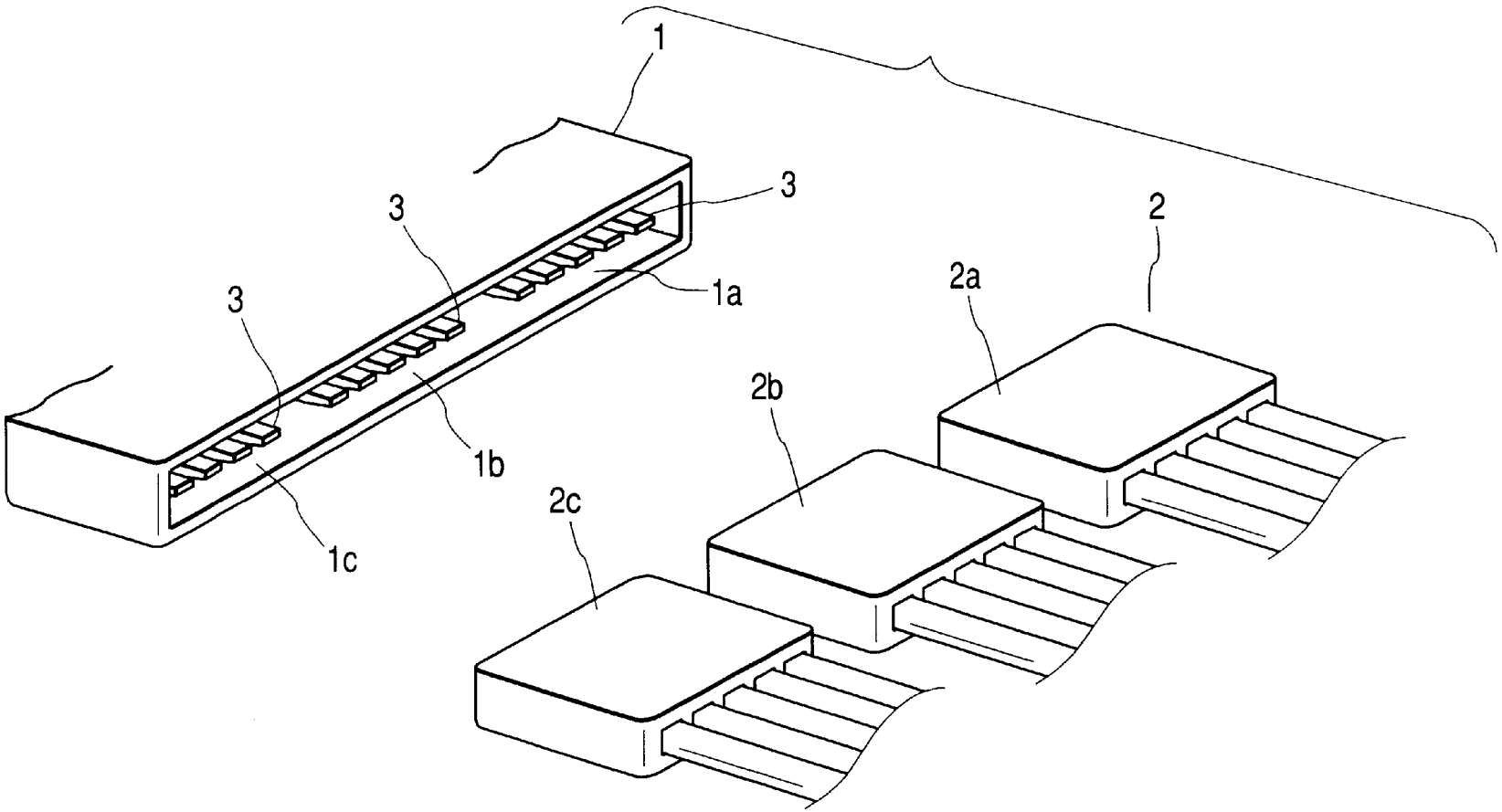
FIG. 14 is a view illustrating a related apparatus and corresponding to FIG. 4.

The pushing operation force transmitting member 20-is a plate-like member that has a length in an upward or downward direction perpendicular to all the chambers 21 of the outer housing 18. As shown in FIGS. 11 and 12, convex portions 44 and 45 serving as engaging portions are respectively provided on a middle part and the bottom end part of a side surface of this member 20 in such a way as to protrude therefrom and as to differ from each other in length, which is to be measured in a direction from a rear part side to a front part side thereof, and in width to be measured in an upward or downward direction. On the other side surface of this pushing operation force transmitting member 20, a convex portion 46 is provided at the top end part thereon in such a manner as to extend over the entire length of the top end part thereon. Furthermore, a convex portion 47 serving as an engaging portion is provided at a front part near to the bottom end part thereon.

The convex portion 46 has a plurality of (in this case, three) step parts 48, 49, and 50, which are provided in the top surface side portion thereof and extend in frontward and backward directions and serve as engaging portions, and also has a single step part 51 provided in the bottom surface side portion thereof. Further, the convex portion 47 has a slope part 52 that is provided in the bottom surface side rear part thereof and that has an upward inclination toward the backward side thereof.

Furthermore, a projection 53 and a through groove 54 for elastically deforming the projection 53 in frontward and backward directions are formed in an upper part of a rear edge portion of the pushing operation force transmitting member 20.

In this configuration, the pushing operation force transmitting member 20 is inserted into the outer housing 18 through a cutout portion (not shown) from the hole 29 thereof so that only the convex portion 46 is upwardly projected from the outer housing 18. Furthermore, in such a state, each of the inner housings 19 is inserted into a corresponding one of the chambers 21 of the outer housing 18 from a frontward direction in such a way as to be provided in steps (in this case, three steps) across the height thereof.

Referring to FIGS. 13A to 13C and FIG. 4, there is shown a state in which the pushing operation force transmitting member 20 and the inner housings 19 are incorporated into the outer housing 18. The inner housing 19 provided as the lowest step is in a state in. which the step part 31 thereof is made to abut against and engage with the convex portion 45 of the pushing operation force transmitting member 20 and is held at a position wherein when the part 31 is at this position, the step part 31 thereof protrudes most from the outer housing 18. The inner housing 19 provided as the middle step is in a state in which the step part 31 thereof is made to abut against and engage with the convex portion 44 of the pushing operation force transmitting member 20 and in which the step part 38 thereof is made to abut against and engage with the convex portion 47 of the member 20 and is held at a position-wherein when the part 31 is at this position, the step part 38 thereof protrudes a little from the outer housing 18. The inner housing 19 provided as the highest step is in a state in which the step part 31 thereof is advanced in such a way as to abut against and engage with the inner face of the outer housing 18 and thus entirely accommodated therein.

The projection 42 of the inner housing 19 provided as the lowest step is fitted into the forefront part of the hole 25 formed in the lowest step of the outer housing 18. The projection 42 of the inner housing 19 provided as the middle step is fitted into the forefront part of the hole 24 formed in the middle step. The projection 42 of the inner housing 19 provided as the highest step is fitted into the hole 23 formed in the highest step without frontward and backward margins.

Lead wires 55 connected to the female contacts 40 are backwardly drawn out of each of the inner housings 19. The lead wires 55 are backwardly drawn out of the outer housing 18 from a hole 56 (see FIG. 4) formed in a rear wall portion of the outer housing 18.

Next, an operation of the apparatus of the aforementioned configuration is described hereinafter.

Figures 1A, 1B:
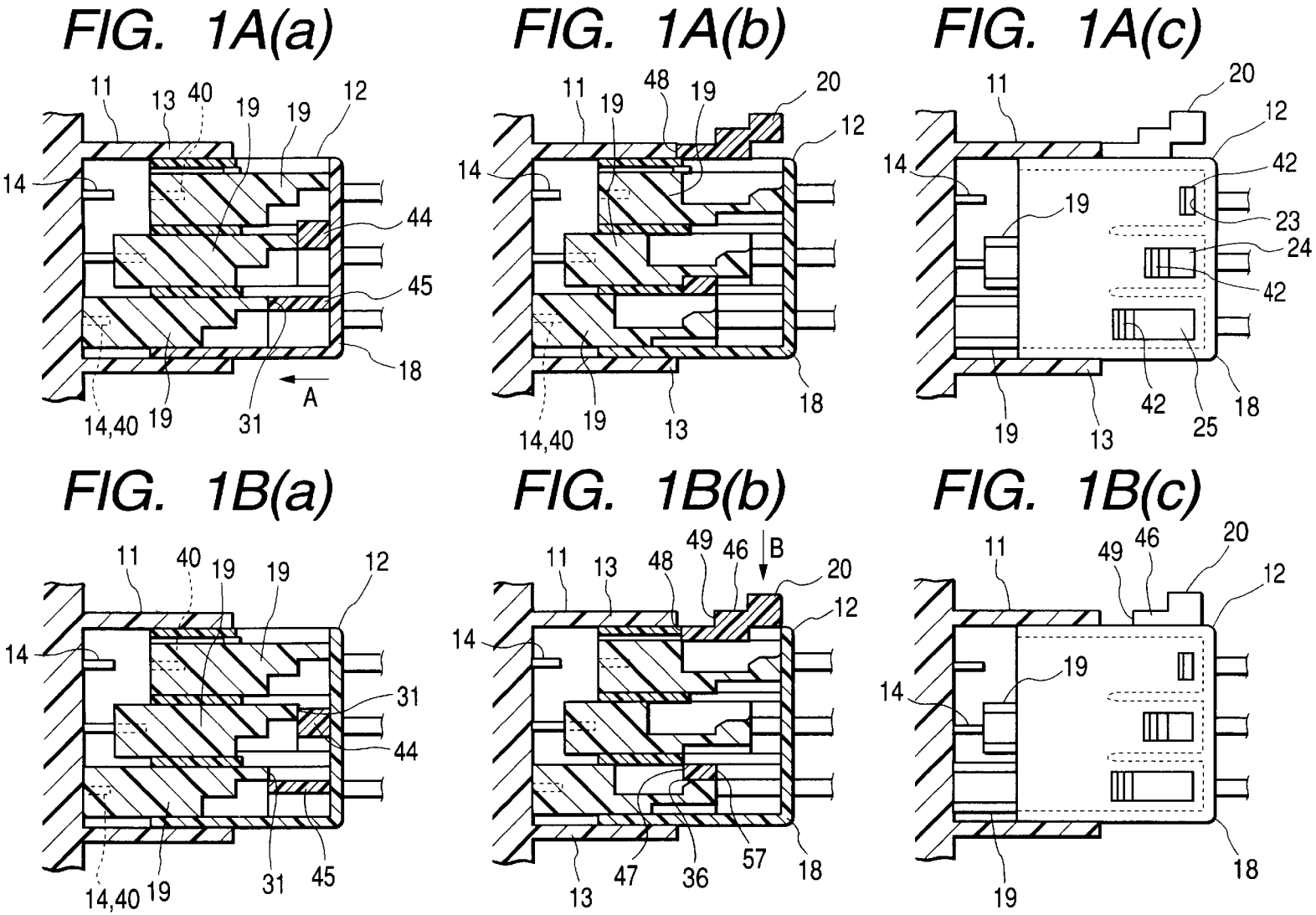
FIGS. 1A(*a*) to 1E(*c*) are pairs of longitudinally sectional views, each pair of which illustrates a male connector and a female connector of an embodiment of the invention taken at different sectional positions (a), (b), and (c) at a corresponding one of sequential stages 1A to 1E of a connecting operation.
Figure 2A:
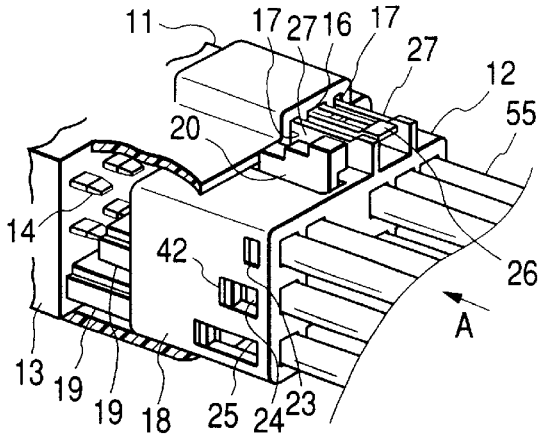
FIGS. 2A to 2E are broken perspective views each illustrating the male connector and the female connector at a corresponding one of the sequential stages 2A to 2B of the connecting operation.

Referring first to FIGS. 1A (*a*) to 1A (*c*) and FIG. 2A, there is shown that the female connector 12 in a state illustrated in FIGS. 13A to 13C and FIG. 4 is pushed into the housing 13 of the male connector 11 as indicated by an arrow A.

At this time, the female connector 12 is pushed into the housing 13 until the step part 48 of the convex portion 46 of the pushing operation force transmitting member 20 abuts against the top edge part of the opened portion of the housing 13 of the male connector 11. Further, all the inner housings 19 of the female connector 12 are thus pushed into the housing 13 of the male connector 11. The inner housing 19 provided as the lowest step having the step part 31 engaged with the convex portion 45 of the pushing operation force transmitting member 20 is pressed (that is, hindered from retreating) by the pushing operation force transmitting member 20 by such an engaging structure. Consequently, the male contacts 14 formed correspondingly to the lowest step is connected to the female contacts 40 provided in the inner housing provided as the lowest step.

Figure 2B:
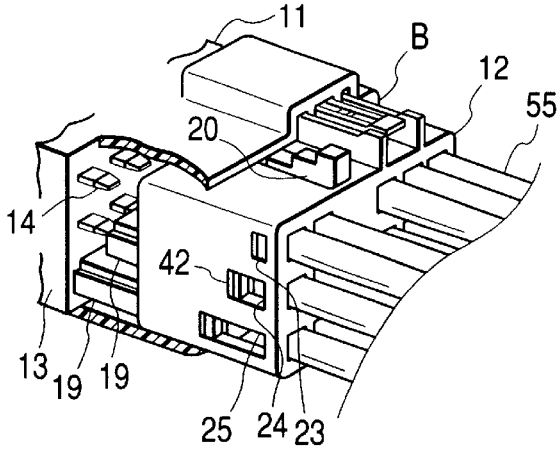

Referring to FIGS. 1B (*a*) to 1B (*c*) and FIG. 2B, there is shown the pushing operation force transmitting member 20 in the aforementioned state is pushed into the outer housing 18 from above, as indicated by an arrow B.

At this time, the pushing operation force transmitting member 20 is pushed into the outer housing 18 until the convex portion 47 reaches a position on the step part 36 of the inner housing 19 provided as the lowest step (that is, abuts against an upper step part 57). The engagement between the pushing operation force transmitting member 20 and the convex portion 45 of the inner housing 19 provided as the lowest step is disengaged by downwardly shifting the convex portion 45 from the step part 31. Then, the convex portion 44 is downwardly shifted from an initial engaging position at which the portion 44 engages with the step part 31 of the inner housing 19 provided as the middle step. Subsequently, the convex portion 46 is shifted to a position wherein when the convex portion 46 is at this position, the step part 48 faces the inside of the housing 13 of the male connector 11 and the step part 49 faces the top edge-part of the opened portion of the housing 13.

Figure 2C:
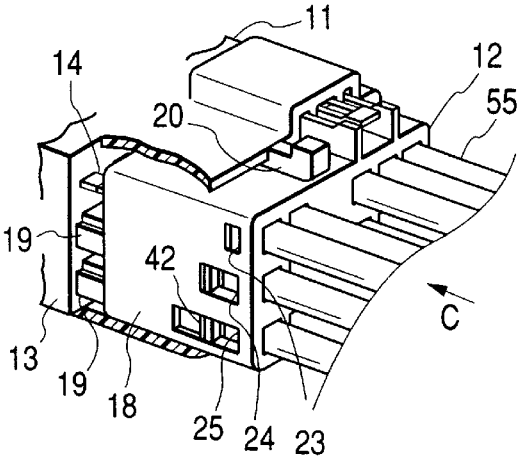

Referring next to FIGS. 1C (*a*) to 1C (*c*) and FIG. 2C, there is shown that the female connector 12 is pushed into the housing 13 of the male connector 11 still more, as indicated by an arrow C.

At that time, the female connector 12 is pushed into the housing 13 of the male connector 11 until the step part 49 of the convex portion 46 of the pushing operation force transmitting member 20 abuts against the top edge part of the opened portion of the housing 13. Further, thus, both the inner housings 19 respectively provided as the middle step and the highest step are pushed into the housing 13 of the male connector 11 still more. Between these, the inner housing 19 provided as then middle step having the step part 31 engaged with the convex portion 44 of the pushing operation force transmitting member 20 is pressed by the pushing operation force transmitting member 20 by such an engaging structure. Consequently, the male contacts 14 of the middle step of the connector 11 is fitted into the female contacts 40 of the housing provided as the middle step.

At this time, the convex portion 45 of the pushing operation force transmitting member 20 is made to only advance to the step part 32 in the concave portion 34 of the inner housing 19 provided as the lowest step. Therefore, the convex portion 45 does not provide a pushing force to the inner housing 19 provided as the lowest step.

Moreover, at this time, the outer housing 18 advances to a position wherein when the housing 18 is at this position, the projection 42 of the inner housing 19 provided as the lowest step is placed in a middle portion of the hole 25 formed in the lowest step.

Figure 2D:
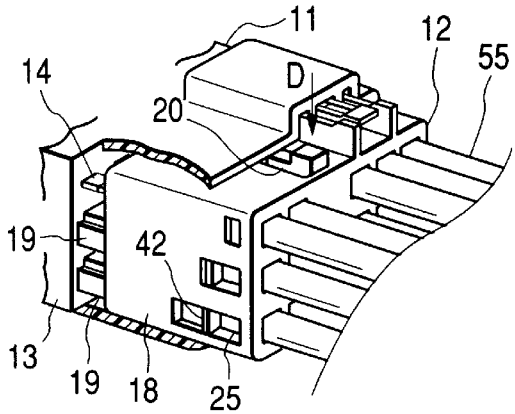

Referring next to FIGS. 1D (*a*) to 1D (*c*) and FIG. 2D, there is shown a state in which the pushing operation force transmitting member 20 is pushed into the outer housing 18 still more from above, as indicated by an arrow D.

At this time, the pushing operation force transmitting member 20 is pushed into the outer housing 18 until the convex portion 47 reaches a position under the step part 36 of the inner housing 19 provided as the lowest step (that is, abuts against a lower step part 58). Thus, the engagement between the convex portion 45 and the inner housing 19 provided as the lowest step is disengaged by downwardly shifting the convex portion 45 from the step part 32 of the inner housing 19, while the engagement between the convex portion 44 and the inner housing 19 provided as the middle step is disengaged by downwardly shifting the convex portion 44 from the step part 31 of the inner housing 19. Furthermore, the convex portion of the pushing operation force transmitting member 20 is shifted to a position wherein when the portion 46 is at this position; the step part 48 is engaged with the step part 35 of the inner housing 19 provided as the highest step, the step part 49 faces the inside of the housing 13 of the male connector 11, and the step part 50 faces the top edge part of the opened portion of the housing 13.

Figure 1E:
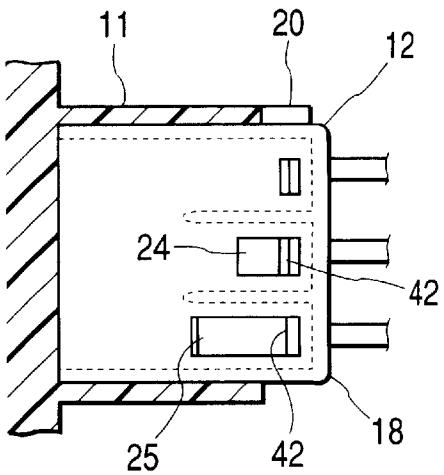
Figure 1E:
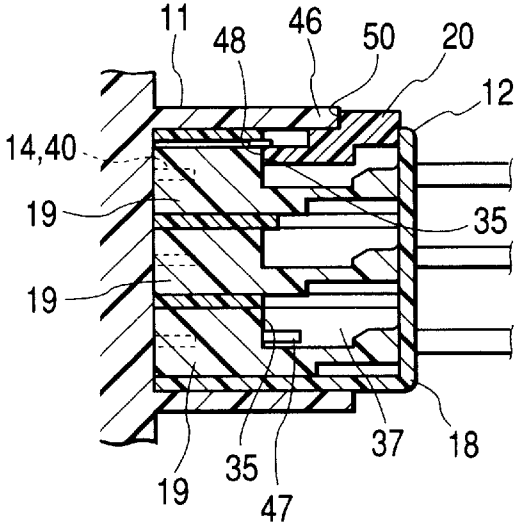
Figure 1E:
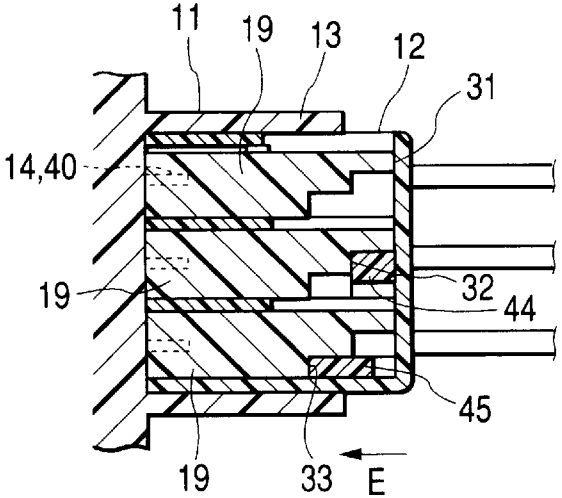
Figure 2E:
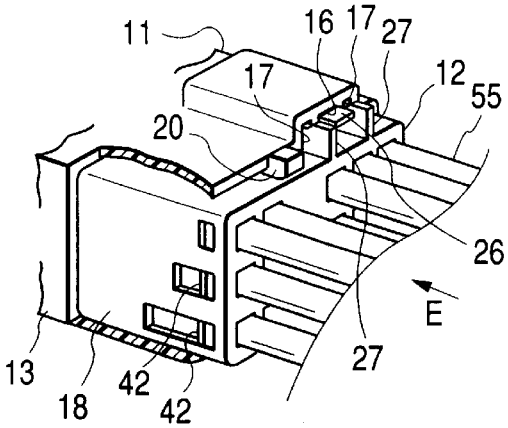

Referring next to FIGS. 1E (*a*) to 1E (*c*) and FIG. 2E, there is shown that the female connector 12 in the aforementioned state is pushed into the housing 13 of the male connector 11 still more, as indicated by an arrow E.

At that time, the male connector 12 is pushed into the housing 13 of the male connector 11 until the step part 50 of the convex portion 46 of the pushing operation force transmitting member 20 abuts against the top edge part of the opened portion of the housing 13. Thus, the step part 35 is engaged with the step part 48 of the convex portion 46 of the pushing operation force transmitting member 20. The inner housing 19 provided as the highest step having the step part 31 engaged with the outer housing 18 is pressed by the pushing operation force transmitting member 20 by such an engaging structure. Consequently, the male contacts 14 formed correspondingly to the highest step of the male connector is fitted into the female contacts 40 of the inner housing 19 provided as the highest step. Thus, all the inner housings 19 of the female connector 12 are connected to the male connector 11.

At this time, the convex portion 45 of the pushing operation transmitting member 20 is made to only advance to the step part 33 in the concave portion 34 of the inner housing 19 provided as the lowest step. The convex portion 44 is made to only advance to the step part 32 in the concave portion 34 of the inner housing 19 provided as the middle step. The convex portion 47 is made to only advance to the step part 35 in the concave portion 37 of the inner housing 19 provided as the lowest step. Therefore, these convex portions do not give pushing forces to the inner housing 19 provided as the lowest step and the housing 19 provided as the middle step.

At this time, the outer housing 18 advances to a position wherein when the housing 18 is at this position, the projection 42 of the inner housing 19 provided as the lowest step is placed at the rearmost portion of the hole 25 formed in the lowest step, and the projection 42 of the inner housing 19 provided as the middle step is placed at the rearmost portion of the hole 24 formed in the middle step.

Furthermore, the ribs 27 of the female connector 12 are inserted into the guide groove 17 of the male connector 11, and also guide the connectors into a connected state. The elastic tongue strip 26 of female connector 12 is inserted into the concave portion 16 and finally maintains the connected state by engaging the nail 28 with a nail hook portion (not shown)

Figure 3F:
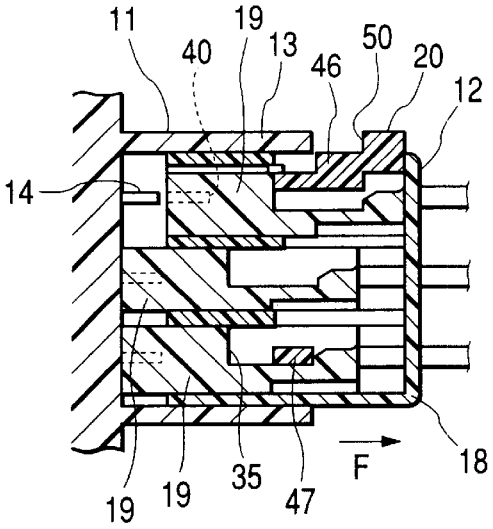
FIGS. 3F(*a*) to 3I(*b*) are pairs of longitudinally sectional views, each pair of which illustrates the male connector and the female connector taken at different sectional positions (a) and (b) at a corresponding one of sequential stages 3F to 3I of a separating operation.
Figure 3F:
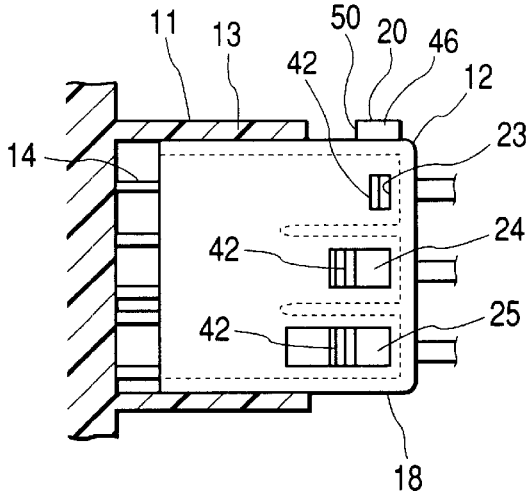

On the other hand, FIGS. 3F (*a*) and 3F (*b*) illustrate a state where the nail 28 is disengaged from the nail hook portion (not shown) by pushing the leading end portion of the elastic tongue strip 26, which remains placed outside the concave portion 16, in the aforementioned condition, and where the female connector 12 is then pulled out of the male connector 11 as indicated by an arrow F.

At this time, the inner housing 19 provided as the highest step having the projection 42 engaged with the hole 23 formed in the highest step is pulled by the outer housing 18 by such an engaging structural Thus, the female contacts 40 is detached and separated from the male contact 14 of the highest step of the male connector 11.

Moreover, at this time, the outer housing 18 is retreated to a position wherein when the housing 18 is at this position, the projection 42 of the inner housing 19 provided as the middle step is placed at the forefront portion of the hole 24 formed in the middle step, and the projection 42 of the inner housing 19 provided as the lowest step is placed in a middle portion of the hole 25 formed in the lowest step. The step part 50 of the concave portion 46 of the pushing operation force transmitting member 20 is detached from the top edge part of the opened portion of the housing 13 of the male connector 11. The concave portion 47 is detached from the step part 35 of the inner housing 19 provided as the lowest step.

Figure 3G:
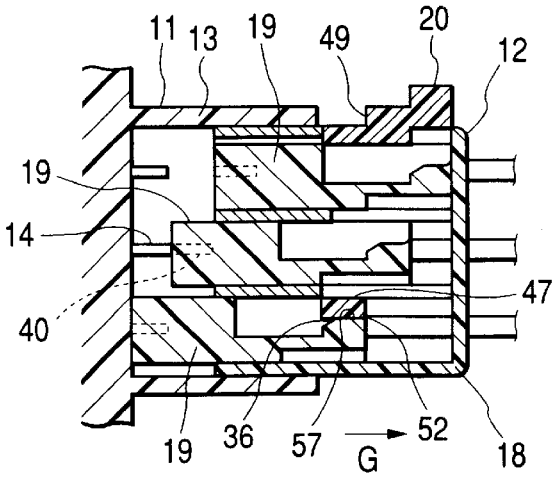
Figure 3G:
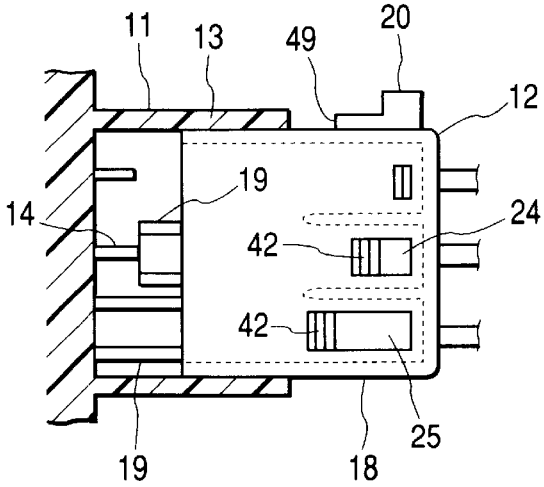

Referring next to FIGS. 3G (*a*) and 3G (*b*), there is illustrated a state where the female connector 12 in the aforementioned state is pulled out of the male connector 11 still more, as indicated by an arrow G.

At that time, similarly as in the aforementioned case, the inner housing 19 provided as the highest step is pulled. The inner housing 19 provided as the middle step having the projection 42 engaged with the forefront part of the hole 24 formed in the middle step of the outer housing 18 is pulled by the outer housing 18 by such an engaging structure. Thus, the female contacts 40 are detached and separated from the male contacts 14 of the male connector 11.

Figure 3H:
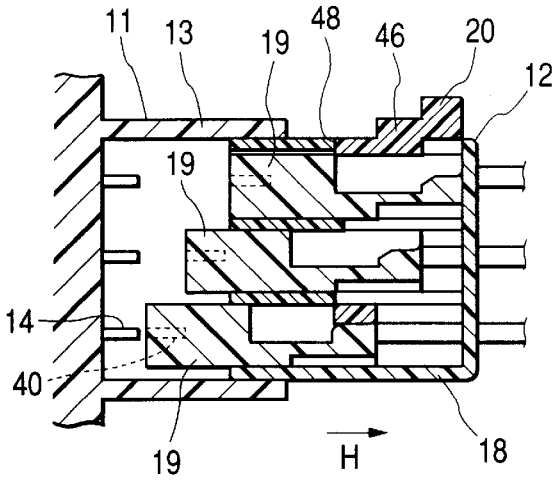
Figure 3H:
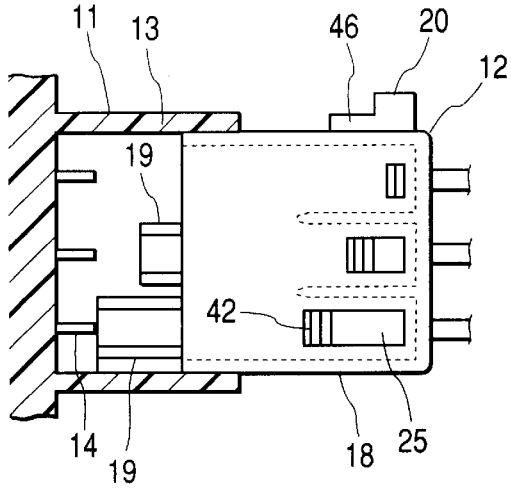

At this time, the outer housing 18 retreats to a position wherein when the housing 18 is at this position, the projection 42 of the inner housing 19 provided as the lowest step is placed at the forefront part of the hole 25 formed in the lowest. step. Furthermore, the slope part 52 of the convex portion 47 slides over the slope of the step part 36, so that the pushing operation force transmitting member 20 is upwardly moved to a position; on the step part 36 (that is, moved to an upper step part 57). Moreover, the step part 49 is detached from the top edge part of the opened portion of the housing 13 of the male connector Referring next to FIGS. 3H (*a*) and 3H (*b*), there is illustrated a state where the female connector 12 is pulled out of the male connector 11 still more, as indicated by an arrow H.

At that time, similarly as in the aforementioned case, both the inner housing 19 provided as the highest step and the inner housing 19 provided as the middle step are pulled. Moreover, the inner housing 18 provided as the lowest step having the projection 42 engaged with the forefront part of the hole 25 formed in the lowest step is pulled by the outer housing 18 by such an engaging structure. Thus, the female contacts 40 are detached and separated from the male contacts 14 formed correspondingly to the lowest step of the male connector 11. Thus, all the inner housings 19 of the female connector-12 are separated from the male connector 11. Therefore, in this case, the holes 23 and 24 of the housing 18 of the female connector 12 and the projection 42 of each of the inner housings 19 serve as separating operation force transmitting means for transmitting a separating operation force, which is applied to the outer housing 18, to the inner housings 19 sequentially.

Further, at that time, the step part 48 of the pushing operation force transmitting member is detached from the top edge of the opened portion of the housing 13 of the male connector 11 by keeping the step part 48 placed under the top end part thereof.

Figure 3I:
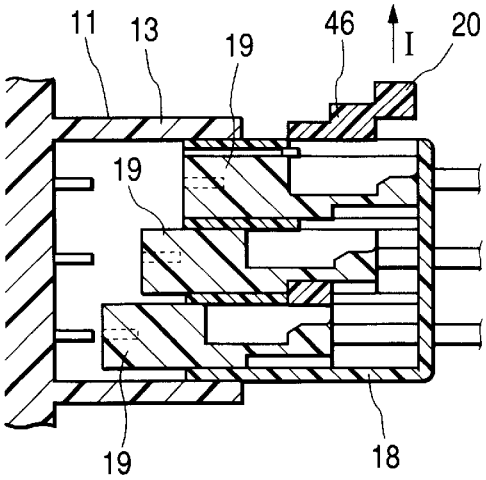
Figure 3I:
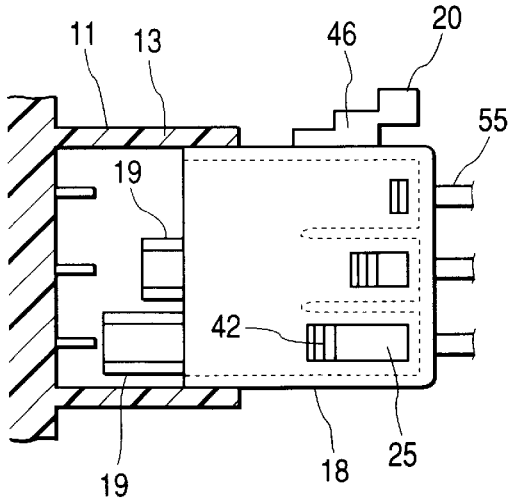

Referring next to FIG. 3I (*a*) and 3I (*b*), there is illustrated a state where the pushing operation force transmitting member 20 in the aforementioned state is upwardly moved as indicated by an arrow I. Thus, the female connector 12 is returned to a state in which the connectors are not connected to each other yet.

The positions of the pushing operation force transmitting member 20 moved up and down as described above are maintained by a frictional force generated by causing the convex portions 44 to 47 to abut against the inner housings 19 and a frictional force generated by pressure-contacting the projection 53 with an inner face part of the outer housing 18 owing to elasticity of the through groove 54.

Thus, according to the connector apparatus of this configuration, a plurality of steps respectively constituted by the inner housings 19 of the female connector 12 can be sequentially connected to the male connector 11 by alternately pushing the outer housing 18 of the female connector 12 and the pushing operation force transmitting member 20. Thus, this invention can save trouble in connecting the female connectors 2*a*, 2*b*, and 2*c*, which are provided correspondingly to the single male connector 1 in the related apparatus by dividing a single female connector, to the portions 1*a*, 1*b*, and 1*c* of the male connector 1. Consequently, a connecting operation can be facilitated.

Moreover, although the total number of the female contacts 40 of the female connector 12 of the apparatus of the invention is large, the female contacts are distributed among the inner housings 19, so that the number of the female contacts 40 of each of the inner housings 19 is small. Therefore, an operating force needed for the connection between the male connector 11 and each of the inner housings 19 can be reduced.

Additionally, in the case of the connector apparatus of the invention, the inner housings 19 of the female connector 12 can be sequentially separated from the male connector 11 by using the separating operation force transmitting means consisting of the holes 23 and 24 of the outer housing 18 of the female connector 12 and the projection 42 of each of the inner housings 19. Thus, the apparatus of the invention can save trouble in separating the female connectors 2*a*, 2*b*, and 2*c* from the portions 1*a*, 1*b*, and 1*c* of the male connector 1 of the related apparatus. Consequently, a separating operation can be facilitated.

Although the female connector 12 is provided with the plurality of the inner housing 19 in this embodiment of the invention, instead, the male connector 11 may be provided with the plurality of the housing 19. Further, the positional relation in upward and downward directions among all of constituent elements of the embodiment may be reversed. Moreover, a connector apparatus of the invention may be implemented by converting the positional relation in upward and downward directions among all of constituent elements of the embodiment into the positional relation in lateral directions there among. Furthermore, the relation between the concave portions, which are implemented by the holes 23 to 25 of the separating operation force transmitting portion, and the convex portions, which are implemented by the projections 42, may be reversed.

Additionally, the invention is not limited to the embodiment described in the foregoing description and illustrated in the drawings. The invention can be practiced by being suitably changed without departing from the gist thereof.

The apparatus of the invention is constituted as described above, and thus has the following effects.

According to the connector apparatus of the invention, a plurality of steps respectively constituted by the inner housings of the female connector can be sequentially connected to the male connector by alternately pushing the outer housing of the female connector and the pushing operation force transmitting member. Thus, an operating force needed for the connection between the male and female connectors can be reduced. Moreover, a connecting operation can be facilitated.

According to an embodiment of this connector apparatus of the invention, the inner housings of the female connector can be sequentially separated from the male connector by using the separating operation force transmitting means. Thus, a separating operation can be facilitated.

What is claimed is:

1. A connector apparatus having a male connector and a female connector, one of the male connector and a female connector comprising:

an outer housing;

a plurality of inner housings positioned in steps and provided in the outer housing, each of the inner housings being movable with respect to the outer housing and having at least one contact; and a pushing operation force transmitting member engageable with the plurality of inner housings in a plurality of engagement states which is changed when the pushing operation force transmitting member, incorporated into the outer housing, is externally operated, wherein the pushing operation force transmitting member sequentially transmits a pushing force which is applied to the outer housing in a direction toward the other connector to each inner housings by changing the plurality of engagement states.

2. The connector apparatus according to claim 1 further comprising:

a separating operation force transmitting means, provided at the outer housing and each of the inner housings, for sequentially transmitting a separating operation force which is applied to the outer housing in a direction opposite to the direction of the other connector to each of the inner housings.

3. The connector apparatus according to claim 1 wherein each of the plurality of inner housings has same shape.

4. The connector apparatus according to claim 1 wherein the pushing operation force transmitting member is movable in a direction substantially perpendicular to the direction of other connector.

* * * * *